United States Patent [19]

Nesmith, Jr.

[11] 3,973,813

[45] Aug. 10, 1976

[54] MICROFILM STORAGE DEVICE

[76] Inventor: Charles A. Nesmith, Jr., c/o Stappenbeck Bookbindery, Inc., Box 656, 223 E. Douglas St., Bloomington, Ill. 61710

[22] Filed: June 10, 1974

[21] Appl. No.: 477,637

[52] U.S. Cl. ..... 312/204; 312/257 R; 312/293

[51] Int. Cl.[2] ..... A47B 17/04; A47B 77/18

[58] Field of Search ..... 312/204, 234, 290, 321, 312/326, 350, 257 R, 293

[56] References Cited

UNITED STATES PATENTS

| | | | |
|---|---|---|---|
| 226,717 | 4/1880 | Clacher | 312/204 |
| 456,630 | 7/1891 | Morse | 312/293 |
| 755,688 | 3/1904 | McDonald | 312/293 |
| 2,488,035 | 11/1949 | Pistone | 312/204 |
| 2,547,463 | 4/1951 | Haut | 312/257 R |
| 2,569,209 | 9/1951 | Welk | 312/290 |
| 2,670,261 | 2/1954 | Mueller | 312/204 |
| 2,915,352 | 12/1959 | Piker | 312/257 R |
| 2,926,978 | 3/1960 | Mitchell | 312/257 R |
| 3,301,621 | 1/1967 | Stephenson | 312/234 |
| 3,489,475 | 1/1970 | Boyce et al. | 312/234 |
| 3,628,842 | 12/1971 | Wright | 312/234 |

*Primary Examiner*—Robert L. Wolfe
*Assistant Examiner*—Victor N. Sakron
*Attorney, Agent, or Firm*—Fitch, Even, Tabin & Luedeka

[57] ABSTRACT

A microfilm storage device is disclosed which takes the form of a book-like support cover having a hinged side movable to an open position to expose a pair of storage receptacles each of which is adapted to receive a plurality of microfilm reels or cartridges. The book-like storage device may be stored on a conventional book shelf and utilizes the full depth of the shelf to substantially maximize the number of microfilm reels or cartridges that may be stored on the shelf.

4 Claims, 4 Drawing Figures

MICROFILM STORAGE DEVICE

The present invention relates generally to microfilm storage devices, and more particularly to a microfilm storage device having a novel book-like configuration which may be readily stored on a conventional book shelf and which utilizes the full depth of the book shelf space to substantially maximize the number of microfilm reels or cartridges that may be stored on the shelf.

With the recent advances in and acceptance of microfilm to record and store data and the like, storage of the microfilm for ready access and retrieval for use in microfilm reading machines has become a significant factor. Conventionally, the microfilms are supported on reels which may be placed within individual cartons or boxes to prevent the microfilm from becoming contaminated with dust or other foreign matter. Alternatively, the microfilm reels may be housed within cartridges which allow the microfilm to be unwound from and rewound on the support reels. The microfilm cartridges and individual storage boxes are generally serialized or otherwise identified in a manner to facilitate identification and retrieval of the desired microfilmed data for readout on a microfilm reader.

A typical individual storage box or cartridge for a microfilm reel measures approximately 4 inches along each side and has a depth in the range of approximately 1 to 1½ inches. The individual microfilm reel storage boxes or cartridges may be stored by stacking one on top of the other, or stored in various types of storage devices which conventionally have a plurality of forwardly facing shelves which receive the microfilm storage boxes or cartridges thereon. The typical microfilm storage device has a depth, considered from front to rear, of approximately 4–6 inches. It can be appreciated that with such microfilm storage devices, placement of the storage devices on book shelves of conventional depth, typically approximately 9 inches, utilizes only a small portion of the 9 inch depth of the book shelf, thereby leading to substantial waste space.

In accordance with the present invention, a microfilm storage device is provided which utilizes the full depth of a conventional book shelf so as to substantially maximize the number of individual microfilm cartridges or storage boxes which may be stored on the full shelf area. In carrying out the present invention, a microfilm storage device is provided which has an external book-like shaped support body or cover defined by a pair of generally rigid side walls interconnected by an intermediate connecting wall, one of the side walls being hingedly connected to the intermediate wall for movement between open and closed positions relative to the other side wall. A pair of generally rectangularly shaped storage receptacles are mounted in side-by-side relation between the side walls of the support cover and have open sides facing the hinged side wall. Each of the storage receptacles has a plurality of shelf defining ledges therein which serve to receive a plurality of individual microfilm storage boxes or cartridges. In this manner, microfilm cartridges or storage boxes may be inserted into and removed from the storage receptacles by opening the hinged side wall of the support cover to provide access to the storage receptacles. The book-like shaped microfilm storage device may be placed on a conventional book shelf and utilizes the full depth of the shelf to store microfilm cartridges which, if placed on a book shelf in a conventional manner, would take up only the forward one-half or less of the depth of the book shelf.

Accordingly, one of the primary objects of the present invention is to provide a microfilm storage device which substantially maximizes the number of individual microfilm reel storage boxes or cartridges which may be conveniently stored on conventional width book shelves.

Another object of the present invention is to provide a microfilm storage device which takes the form of a book-like shaped support cover having a hinged side wall which may be opened to provide access to two microfilm storage receptacles each of which is adapted to receive a plurality of individual microfilm reel storage boxes or cartridges therein.

A feature of the present invention lies in the provision of a book-like shaped storage device which allows a plurality of microfilm cartridges to be stored therein and readily identified by identifying indicia disposed externally of the storage device.

Further objects and advantages of the present invention, together with the organization and manner of operation thereof, will become apparent from the following detailed description of the invention when taken in conjunction with the accompanying drawing wherein like reference numerals designate like elements throughout the several views, and wherein.

Figure 1:
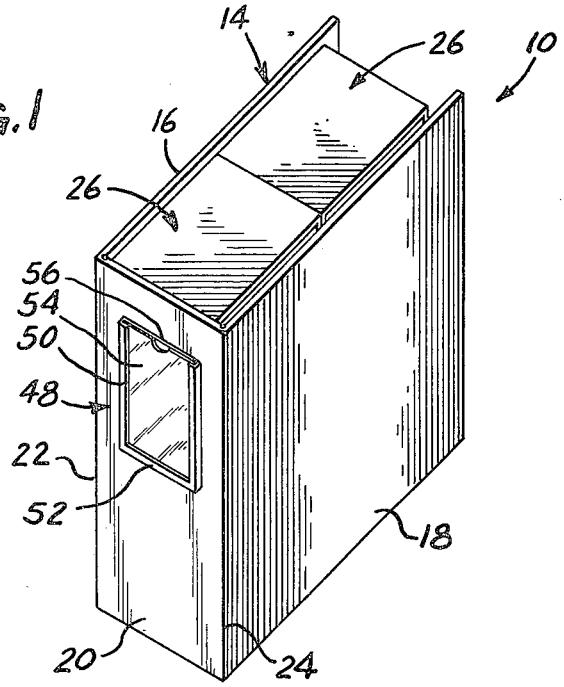
FIG. 1 is a perspective view of a microfilm storage device constructed in accordance with the present invention.

Referring now to the drawing, a microfilm storage device constructed in accordance with the present invention is indicated generally at 10. The microfilm storage device 10 is adapted to store a plurality of individual microfilm reel storage boxes or cartridges such as shown in phantom at 12 in FIG. 12. The illustrated microfilm cartridges 12 represent conventional microfilm cartridges which generally measure approximately 4 inches along their sides, when considered in plan, and have a vertical depth of approximately 1 to 1½ inches. Contemporary microfilm holders or cartridges are made of plastic and generally serve to substantially enclose a microfilm support reel in a manner to allow the microfilm to be fed off the reel and onto a takeup reel on a microfilm reader machine whereafter the tape may be rewound on the reel within the cartridge. The cartridges may, if desired, be further contained in individual boxes of cardboard or the like. Alternatively, the elements represented by reference numeral 12 may comprise boxes which receive individual microfilm support reels. It will be understood that the microfilm storage device 10 in accordance with the present invention may be adapted for use with either microfilm cartridges or individual microfilm reel storage boxes, and that such cartridges and boxes may have various geometrical configurations.

Figure 2:
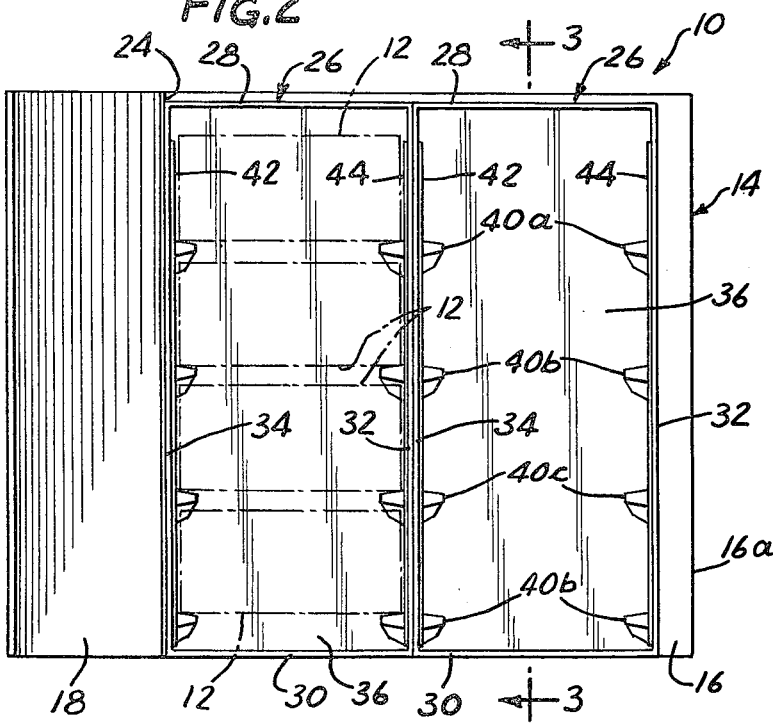
FIG. 2 is a side view of the microfilm storage device of FIG. 1 but having the hinged side wall open to expose the microfilm cartridge support receptacles.

The microfilm storage device 10 includes a support body or cover, indicated generally at 14, which takes the form of a book-like shaped body having a pair of generally rigid planar side walls 16 and 18 and an intermediate connecting wall 20. The wall 20 is fixedly connected to the side wall 16 along a longitudinal edge 22 which is common to both the walls 16 and 20 so that the wall 20 forms a generally fixed right angle with the plane of the side wall 16. The intermediate wall 20 is connected along its opposite longitudinal or lateral edge 24 to a lateral edge of the side wall 18, with the edge 24 forming a hinge connection between the side wall 18 and the intermediate wall 20. In this manner, the side wall 18 may be moved between a closed position, as shown in FIG. 1, and an open position, as shown in FIG. 2, by moving the side wall 18 about the hinge connection 24 relative to the side wall 16, much the same as one would open a book cover. The walls 16, 18 and 20 may be formed from an integral sheet of heavy fiberboard or other suitable material which is formed into the described configuration of the support body 14 by conventional techniques. If desired, the body member 14 may comprise an inexpensive but suitable strength core material having an external sheath or cover secured to its exposed surfaces to improve the visual appearance of the storage device 10.

The microfilm storage device 10 includes a pair of identically shaped cartridge support receptacles or boxes, each of which is indicated generally at 26, which are adapted to receive and support a plurality of the microfilm cartridges 12. Each of the cartridge support receptacles 26 comprises a generally rectangularly shaped box having upper and lower ends 28 and 30, respectively, longitudinally extending sides 32 and 34, and a rear wall 36. The rectangular receptacles 26 are made of a suitable strength light weight material, such as relatively stiff cardboard, and are open on the sides thereof opposite the rear walls 36 to provide access to the interiors of the receptacles.

As illustrated, a pair of the cartridge support receptacles 26 are secured in side-by-side relation to the inner surface of the side wall 16 of the support body 14 by affixing the rear walls 36 of the receptacles to the side wall 16 by a suitable adhesive or the like. The adjacent walls 32 and 34 of the side-by-side receptacles 26 are also preferably secured together to improve rigidity of the overall structure. The side wall 34 of the receptacle 26 adjacent the intermediate wall 20 of the support body 14 may also be adhesively secured to the opposed surface of the wall 20 to further improve structural rigidity. It will be noted that the longitudinal axes of the receptacles 26 are parallel to the lateral edge 16*a* of the side wall 16 of the body member 14, with the wall 16 being of a lateral width sufficient to extend slightly outwardly from the wall 32 of the right-hand receptacle 26, as considered in FIG. 2.

Each of the cartridge support receptacles 26 includes support shelf means for receiving and supporting a plurality of the microfilm cartridges 12. To this end, each of the receptacles 26 has a plurality of pairs of support shelf defining ledges 40*a*, 40*b*, 40*c* and 40*d*, each pair of which is adapted to receive and support an individual microfilm cartridge 12 thereon. With particular reference to FIG. 2, taken in conjunction with FIG. 3, the pairs of support ledges 40*a*, 40*b*, 40*c* and 40*d* may be formed from integral sheets 42 and 44 of suitable thermoplastic sheet material which have generally rectangular planar configurations substantially equal in area to the areas of the side walls 32 and 34, respectively, upon which the formed sheets are secured, as by a suitable adhesive or the like. Each sheet 42 or 44 forms a mirror image of the other, and each sheet has a plurality of the identically shaped parallel spaced ledges 40*a*, 40*b*, 40*c* and 40*d* formed therefrom such that each opposed pair of ledges extend toward the longitudinal axis of the associated receptacle 26 a distance sufficient to underlie the marginal edges of a microfilm cartridge 12. The ledges 40*a*, 40*b*, 40*c* and 40*d* may be formed outwardly from the plane of the associated sheet 42 or 44 by conventional thermoforming techniques. By supporting only the marginal edges of a microfilm cartridge 12, one may readily extend his fingers about a cartridge sufficiently to grasp and remove the cartridge without interference with the cartridge support shelf means as might be occasioned were the cartridge support shelves to extend fully across the lateral width of the associated receptacle 26.

Figure 3:
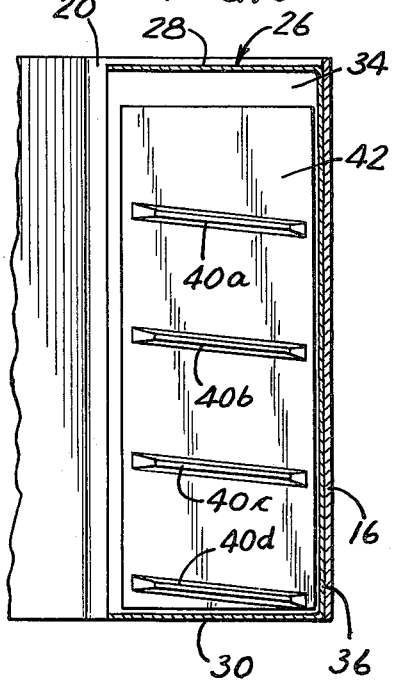
FIG. 3 is a vertical sectional view taken substantially along the line 3—3 of FIG. 2.

Noting FIG. 3, each of the shelf support ledges 40*a*, 40*b*, 40*c* and 40*d* is disposed in a downwardly inclined position relative to the forward open end of the associated receptacle 26 such that when the microfilm cartridges are placed on the respective pair of shelf defining ledges, they will not accidentally slide forwardly or otherwise be subjected to accidental displacement from their associated shelves when the hinged side wall 18 is in an open position.

Preferably, an index card pocket, indicated generally at 48, is affixed to the outer surface of the intermediate side wall 20 of the support body 14 as shown in FIG. 1. The index pocket 48 includes a frame member 50 which has a generally C-shaped channel portion 52 formed along three marginal edges thereof. The channeled edge portion 52 of the frame member 50 receives a transparent plastic cover sheet 54 therein behind which an identifying card 56 may be inserted. The card 56 preferably has indicia printed or written thereon which identifies the microfilm cartridges 12 stored within the associated storage device 10, either by identification of the individual cartridges or by identification of the general subject matter recorded on the microfilm films.

Figure 4:
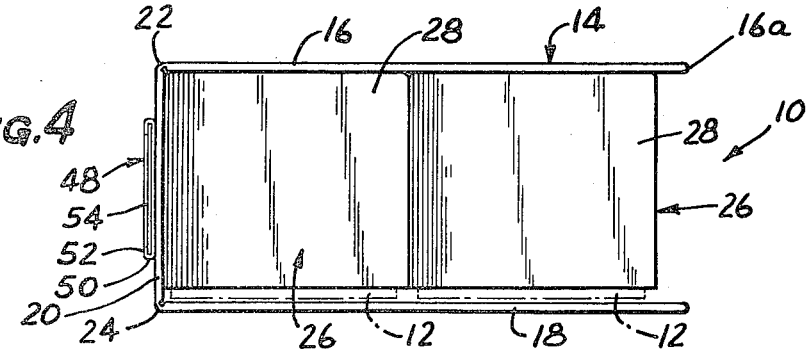
FIG. 4 is a top plan view of the microfilm storage device of FIG. 1.

Having thus described one embodiment of a microfilm storage device 10 in accordance with the present invention, it can be seen that when the hinged wall 18 of the support body 14 is opened to a position as shown in FIG. 2, microfilm cartridges 12 may be readily inserted into or removed from the storage receptacles 26 pursuant to storage or use of the individual microfilm cartridges. When not in use, the hinged side wall 18 of the support body 14 is closed, as shown in FIGS. 1 and 4, against the outermost edges of the microfilm cartridges disposed within the receptacles 26 whereafter the storage device 10 may be placed upon a conventional book shelf.

By providing a support body 14 having side walls 16 and 18 which measure approximately 8½ inches wide and 11 inches high, with the intermediate wall 20 having a lateral width of approximately 4¼ – 4½ inches, the rectangular receptacles 26 may be made such that each receptacle has a generally square transverse cross section measuring approximately 4 inches along each side, and measures approximately 11 inches along its longitudinal length. Two receptacles 26 may thus be readily mounted in side-by-side relation between the side walls 16 and 18 of the support body 14. The number of pairs of support shelf defining ledges, such as 40*a*, 40*b*, 40*c* and 40*d*, may be varied and their spatial relationships established so as to accommodate a maximum number of the microfilm cartridges 12 depending upon the vertical thickness of each cartridge. In the illustrated embodiment, the microfilm cartridges 12 have vertical thickness of approximately 1½ inches and the support ledges 40*a*, 40*b*, 40*c* and 40*d* are formed to support four such microfilm cartridges.

Thus, in accordance with the described embodiment of the microfilm storage device 10, a microfilm storage means is provided which takes the general form of a hard-cover book or binder the hinged side wall of which may be opened to provide access to microfilm cartridge support receptacles. The storage device 10 may be readily supported and stored on a conventional book shelf and utilizes the full depth of the book shelf to store substantially a maximum number of microfilm cartridges on the shelf while being readily removable from the shelf to withdraw or insert a microfilm cartridge from the storage device.

While a preferred embodiment of the present invention has been illustrated and described, it will be obvious to those skilled in the art that changes and modifications may be made therein without departing from the invention in its broader aspects. Various features of the invention are set forth in the following claims.

What is claimed is:

1. A hand-manipulatable book-shaped device for storing microfilm cartridges and the like, comprising a three-sided book-like shaped support cover having a pair of generally rigid side walls and a generally rigid intermediate wall connected along its longitudinal edges to longitudinal edges of said side walls, at least one of said side walls being hingedly connected to said intermediate wall for movement between open and closed positions relative to the other of said side walls, said side walls having lower marginal edges facilitating placement and storage of said device in upstanding relation on a book shelf, a pair of generally rectangularly shaped cartridge support receptacles secured in side-by-side relation to one of said side walls so as to be disposed between said side walls when in their closed positions, said support receptacles defining storage chambers open on the sides thereof facing outwardly from said one of said side walls to which they are secured, said receptacles having stationary top and bottom walls extending between said rigid side walls of said support cover and said receptacles having lateral side walls parallel to said intermediate wall with one of said lateral side walls being exposed and cooperating with said top and bottom walls and said side walls of said support cover to define an enclosed storage chamber when said hingedly connected side wall is in its closed position, said receptacles being box shaped, a plurality of support shelves supported within each of said receptacles within said chamber to receive microfilm cartridges in supporting relation thereon in substantially parallel relation to said lower marginal edges of said side walls, said movable side wall being adapted for movement to expose said shelves for loading and unloading of said cartridges, said movable side wall cooperating with the other of said side walls to retain said cartridges within said receptacles when said movable side wall is in its said closed position, said device having a depth substantially equal to the depth of said book shelf, and substantially the full depth of said device between said side walls being occupied by said cartridge support receptacles for receiving microfilm cartridges thereon.

2. A microfilm storage device as defined in claim 1 wherein said cartridge support receptacle comprises at least one generally rectangularly shaped box open on one side thereof and having said lateral side walls, and wherein said cartridge support shelves comprise pairs of parallel spaced support ledges extending laterally inwardly from the inner surfaces of said lateral side walls sufficiently to support the marginal edges of microfilm cartridges.

3. A microfilm storage device as defined in claim 2 wherein said support ledges are formed from integral sheets of material which are secured to the inner surfaces of the opposing side walls of said box such that said support ledges are disposed in opposed parallel relation.

4. A microfilm storage device as defined in claim 3 wherein said support ledges are inclined downwardly when considered in a rearward direction from the open side of said box toward the side thereof secured to said side wall of said body.

* * * * *